US011035093B2

(12) United States Patent
Ma et al.

(10) Patent No.: US 11,035,093 B2
(45) Date of Patent: Jun. 15, 2021

(54) MULTI-DEGREE-OF-FREEDOM AUTOMATIC CENTER-ADJUSTING DEVICE, HYDRAULIC QUICK-COUPLING DEVICE, AND RESCUE EQUIPMENT

(71) Applicant: University of Science and Technology Beijing, Beijing (CN)

(72) Inventors: Fei Ma, Beijing (CN); Chun Jin, Beijing (CN); Yuchao Liu, Beijing (CN); Yanhua Shen, Beijing (CN); Lulu Gao, Beijing (CN)

(73) Assignee: UNIVERSITY OF SCIENCE AND TECHNOLOGY BEIJING, Beijing (CN)

( * ) Notice: Subject to any disclaimer, the term of this patent is extended or adjusted under 35 U.S.C. 154(b) by 0 days.

(21) Appl. No.: 16/950,926

(22) Filed: Nov. 18, 2020

(65) Prior Publication Data

US 2021/0148080 A1 May 20, 2021

(30) Foreign Application Priority Data

Nov. 20, 2019 (CN) ..... 201911141622.5

(51) Int. Cl.

| | |
|---|---|
| ***E02F 3/36*** | (2006.01) |
| ***E02F 3/96*** | (2006.01) |
| *F15B 15/00* | (2006.01) |

(52) U.S. Cl.

CPC ..... *E02F 3/3677* (2013.01); *E02F 3/3627* (2013.01); *E02F 3/963* (2013.01); *F15B 15/00* (2013.01)

(58) Field of Classification Search

CPC ..... Y10T 403/591; Y10T 403/593; Y10T 403/598; Y10T 403/599; Y10T 403/602;

(Continued)

(56) References Cited

U.S. PATENT DOCUMENTS 6,379,075 B1 * 4/2002 Shamblin ..... E02F 3/3613 37/468
7,654,019 B2 * 2/2010 Yeager ..... E02F 3/3663 37/468

(Continued)

FOREIGN PATENT DOCUMENTS

CN 107806126 A * 3/2016
CN 109555177 A 4/2019

*Primary Examiner* — Edwin J Toledo-Duran

(74) *Attorney, Agent, or Firm* — Bayramoglu Law Offices LLC

(57) ABSTRACT

A multi-degree-of-freedom automatic center-adjusting device, a hydraulic quick-coupling device, and rescue equipment are provided. The automatic center-adjusting device includes an active coupling valve set, a spring, and a dynamic adjustment swing rack. A first end of the dynamic adjustment swing rack is fixed to operation tools, and a second end of the dynamic adjustment swing rack is connected to the active coupling valve set through the spring. The dynamic adjustment swing rack includes a frame, a limit slot, and a spring limit cylinder, wherein the frame is used to support and fix the active coupling valve set, the limit slot is used to define a limit activity position of the active coupling valve set, and the spring limit cylinder is used to constrain the spring. The automatic center-adjusting device is used to solve technical problems of position errors and a center mismatch in a coupling process.

15 Claims, 2 Drawing Sheets

(58) Field of Classification Search
CPC ..... E02F 3/3609; E02F 3/3613; E02F 3/3631; E02F 3/364; E02F 3/365; E02F 3/3663
USPC ..... 403/322.1, 322.3, 324, 325, 327; 414/723; 37/468; 172/272
See application file for complete search history.

(56) References Cited

U.S. PATENT DOCUMENTS

| | | | | |
|---|---|---|---|---|
| 8,602,676 | B2 * | 12/2013 | Stollery | E02F 3/3631<br>403/322.1 |
| 9,970,177 | B2 * | 5/2018 | Koestler | E02F 3/3663 |
| 2006/0037220 | A1 * | 2/2006 | Cunningham | E02F 3/365<br>37/468 |

* cited by examiner

MULTI-DEGREE-OF-FREEDOM AUTOMATIC CENTER-ADJUSTING DEVICE, HYDRAULIC QUICK-COUPLING DEVICE, AND RESCUE EQUIPMENT

CROSS-REFERENCE TO RELATED APPLICATIONS

This application is based upon and claims priority to Chinese Patent Application No. 201911141622.5, filed on Nov. 20, 2019, the entire contents of which are incorporated herein by reference.

TECHNICAL FIELD

The present disclosure relates to the technical field of construction machinery and, in particular, to a multi-degree-of-freedom automatic center-adjusting device, a hydraulic quick-coupling device, and rescue equipment.

BACKGROUND

China has frequent natural disasters. After the occurrence of disasters and accidents, the most important role of emergency rescue equipment is to complete all kinds of complex rescue tasks in the shortest time and reduce losses of the affected people. The emergency rescue equipment need to have characteristics of multi-function, high efficiency and preventing secondary personnel injury, so as to meet the operation requirements under complex environments and save people's lives and ensure property safety.

However, China has not yet formed a complete and professional system for emergency rescue equipment. When disasters occur, rescue tasks are mostly completed by construction machinery or rescue equipment equipped with construction machinery working arms. Due to the limitation of working attributes, rescue equipment working arms often have a single function, poor interchangeability of operation tools, and slow assembly and disassembly speeds (required time>30 min), which does not meet the requirements of rescue sites, resulting in low rescue efficiency. In addition, in consideration of complex situations at a rescue site, poor road traffic conditions, small rescue space, and frequent personnel exchanges, multiple rescue vehicles are not allowed to enter the site for operation at the same time. Otherwise, all the functions cannot be performed well, and it is more likely to cause working arms to interfere with each other and on-site chaos, thereby reducing the rescue efficiency. A variety of operational functions need to be integrated on a device or an working arm to implement such functions as gripping and carrying, expanding and forcible entry, dragging and pulling, earth pushing and breaking, aerial work, lifting and cutting, etc. However, there are often various dangerous factors at a rescue site. An operator is not allowed to leave the cab for loading and unloading. The requirements of automatic switching and fast switching of operation tools have to be met, so as to provide safety guarantee for rescue workers The automatic center-adjusting device in the present disclosure is used to solve the problem that a hydraulic coupling valve core cannot be aligned due to mechanical errors, coupling errors, and wear of mechanical parts. The present disclosure can greatly improve the coupling rate and accuracy.

SUMMARY

In view of this, the present disclosure provides a multi-degree-of-freedom automatic center-adjusting device and a hydraulic quick-coupling device, to solve the problem of difficult coupling of operation fitting pipes that require a hydraulic power oil line when existing emergency rescue equipment changes operation tools. The present disclosure can solve the problem of buffering and error compensation of a bidirectional asymmetric valve set, and can easily complete a coupling operation.

In an aspect, the present disclosure provides a multi-degree-of-freedom automatic center-adjusting device, including an active coupling valve set and a dynamic adjustment swing rack, one end of the dynamic adjustment swing rack is fixed to operation tools, and the other end is connected to the active coupling valve set through a spring, the dynamic adjustment swing rack includes a frame, a limit slot, and a spring limit cylinder, the frame is used to support and fix the active coupling valve set, the limit slot is used to define a limit activity position of the active coupling valve set, and the spring limit cylinder is used to constrain the spring.

In the aspect described above and any possible implementation mode, an implementation mode is further provided: the active coupling valve set includes a hydraulic valve core, a guide sleeve, a limit screw, and a spring limit hole, the spring limit hole is disposed at the back of the hydraulic valve core, the spring limit hole is used to constrain the spring, there are four limit screws respectively mounted to an outer side of the hydraulic valve core, the limit screws and the limit slot form a constraint relation to jointly constrain displacement of the hydraulic valve core in an X direction and a Z direction.

In the aspect described above and any possible implementation mode, an implementation mode is further provided: the hydraulic valve core is supported by the springs, and when the hydraulic valve core is not subjected to an external force, a hydraulic valve block is on an outermost side of the X direction and the spring is in a non-deformed state.

In the aspect described above and any possible implementation mode, an implementation mode is further provided: the distance between two parallel sides composed of four limit slots is greater than the diameter of the limit screw, the limit screw moves and swings when the hydraulic valve core is subjected to a force, wherein the movement includes forward and backward movement in the X-axis direction, up and down movement in the Z-axis direction, and minor movement in the Y-axis direction, and the swing includes circular swing with the Y-axis as an axis of symmetry, circular swing with the Z axis as an axis of symmetry, and minor circular swing with the X axis as an axis of symmetry.

In the aspect described above and any possible implementation mode, a hydraulic quick-coupling device is further provided: the hydraulic quick-coupling device includes an active coupling module, a passive coupling module, and a hydraulic coupling module, the active coupling module is mounted to the end of an emergency rescue equipment working arm, the passive coupling module is fixed to the operation tools, the active coupling module is connected to the passive coupling module through the hydraulic coupling module, and the hydraulic coupling module includes multiple sets of automatic center-adjusting devices and hydraulic joints.

In the aspect described above and any possible implementation mode, an implementation mode is further provided: a plurality of hydraulic valve cores in the hydraulic coupling module all have a unified oil channel interface, and the hydraulic coupling module is used to connect and disconnect a hydraulic pipeline between the active coupling module and the passive coupling module.

In the aspect described above and any possible implementation mode, an implementation mode is further provided: the dynamic adjustment swing rack is disposed in the passive coupling module.

In the aspect described above and any possible implementation mode, an implementation mode is further provided: the active coupling module is mounted to the end of the emergency rescue equipment working arm.

In the aspect described above and any possible implementation mode, an implementation mode is further provided: the active coupling valve set is disposed at the active coupling module, and the active coupling valve set is connected to the dynamic adjustment swing rack through the hydraulic joints.

In the aspect described above and any possible implementation mode, rescue equipment is further provided: the rescue equipment includes an emergency rescue equipment working arm, a control system, and a hydraulic quick-coupling device, one end of the hydraulic quick-coupling device is connected to the control system through the emergency rescue equipment working arm, and the other end is connected to operation tools.

Compared with the related art, the present disclosure can obtain the following technical superiority: the present disclosure provides a solution for position errors and center mismatch in a coupling process, and provides technical support for a hydraulic automatic coupling technology. The multi-degree-of-freedom automatic center-adjusting device and the hydraulic quick-coupling device in the present disclosure are simple in structure and clear in principle, which include internal components that are mostly sheet metal parts and welding parts, have low costs, and are strong and durable, and suitable for emergency rescue operations.

Certainly, implementation of any product in the present disclosure does not necessarily achieve all the above technical superiority at the same time.

BRIEF DESCRIPTION OF THE DRAWINGS

In order to more clearly illustrate the technical solutions in embodiments of the present disclosure, the accompany drawings used in the embodiments will be briefly introduced below. It is apparent that, the accompany drawings in the following description are only some embodiments of the present disclosure, and other drawings can be obtained by those of ordinary skill in the art from the provided drawings without creative work.

In the figures, A: active coupling valve set; B: dynamic adjustment swing rack; 1: hydraulic valve block; 2: guide sleeve; 3: spring; 4: limit slot; 5: frame; 6: limit screw; 7: spring limit hole; 8: spring limit cylinder; c: operation tools; d: active coupling module; e: passive coupling module; f: hydraulic coupling module.

DETAILED DESCRIPTION OF THE EMBODIMENTS

To better understand the technical solution of the present disclosure, the embodiments of the present disclosure are described in detail below with reference to the accompanying drawings.

It should be made clear that the described embodiments are only some instead of all of the embodiments of the present disclosure. All other embodiments obtained by those of ordinary skill in the art based on the embodiments in the present disclosure without creative work fall within the protection scope of the present disclosure.

The terms used in the embodiments of the present disclosure are for the sole purpose of describing specific embodiments and are not intended to limit the present disclosure. The singular forms "one", "said", and "the" used in the embodiments and appended claims of the present disclosure are also intended to include plural forms, unless the context clearly indicates other meanings.

Figure 3:
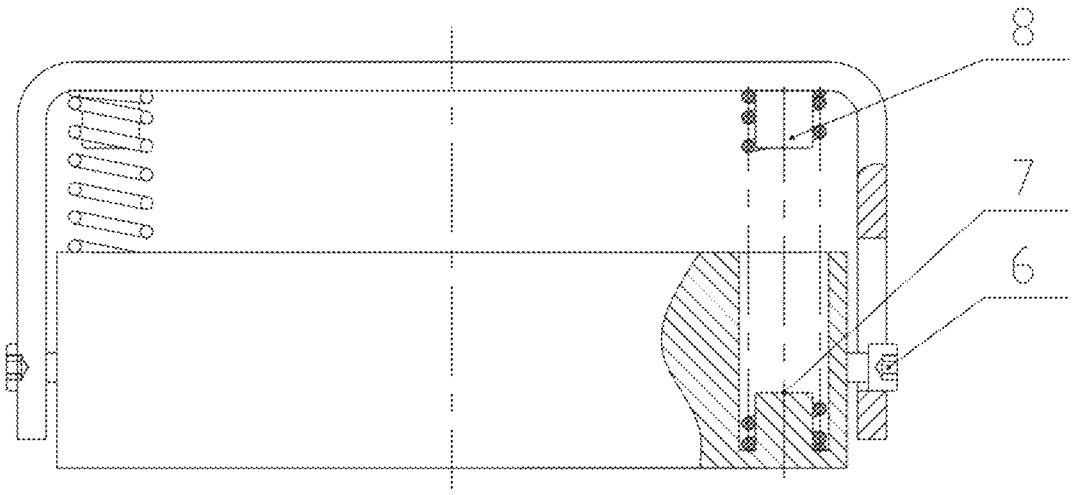
FIG. 3 is a front view of a multi-degree-of-freedom automatic center-adjusting device provided by the present disclosure.
Figure 4:
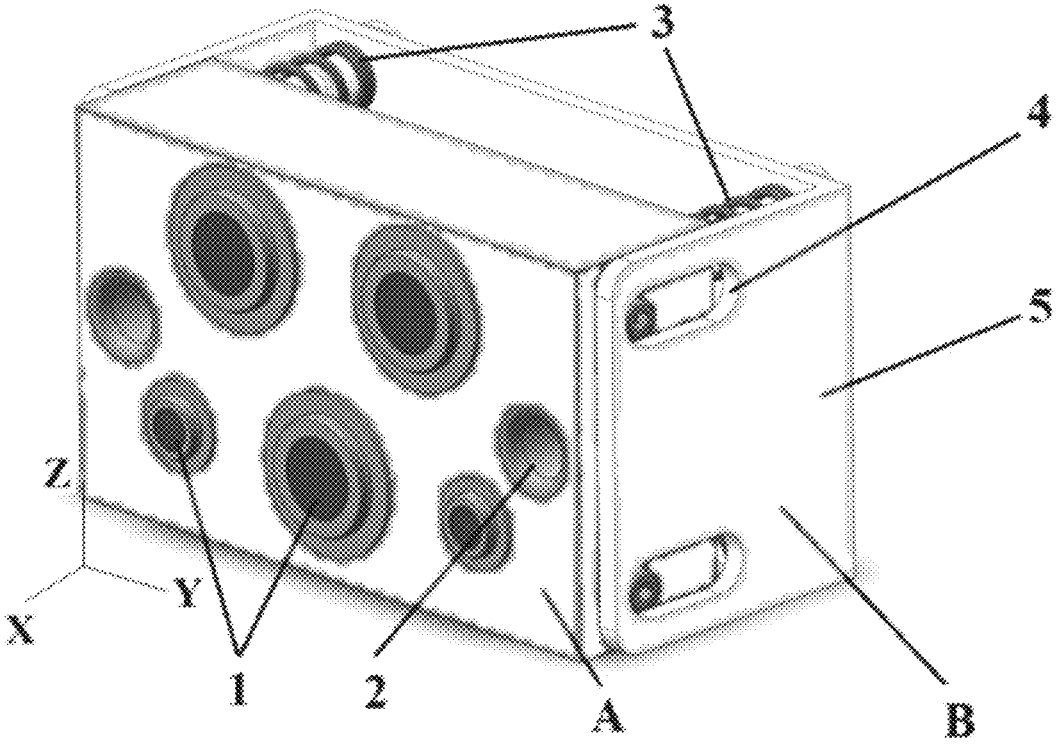
FIG. 4 is a structural diagram of the multi-degree-of-freedom automatic center-adjusting device provided by the present disclosure.

The present disclosure provides a multi-degree-of-freedom automatic center-adjusting device, including an active coupling valve set A and a dynamic adjustment swing rack B. As shown in FIG. 3 and FIG. 4, the active coupling valve set A is a part of a hydraulic coupling module f in emergency rescue equipment, in which a plurality of hydraulic joints are mounted. The dynamic adjustment swing rack B is fixed to operation tools c. The active coupling valve set A is flexibly connected to the dynamic adjustment swing rack B, thus having multi-degree-of-freedom movement and swing functions.

The dynamic adjustment swing rack B includes a frame 5, a limit slot 4, a spring limit cylinder 8, and a spring 3. The frame 5 is used for integral fixing, the limit slot 4 is used to define a limit position of a hydraulic valve block 1, and the spring limit cylinder 8 is used to constrain the spring 3. The spring 3 is used for connection between a coupling valve set and the dynamic adjustment swing rack B.

A hydraulic valve set includes a valve core, a guide sleeve 2, limit screws 6, and a spring limit hole 7. The spring limit hole 7 is located at the back of the valve set and used to constrain the spring 3. Four limit screws 6 are located on two sides of the valve set respectively and used to form a constraint relationship with the limit slot 4 to constrain displacement of the hydraulic valve block 1 in X and Z directions.

The hydraulic valve set and the swing rack have the following features in terms of connection modes: the hydraulic valve set is supported by the spring 3; when not subjected to an external force, the hydraulic valve block 1 is on an outermost side of the X direction due to the support of the spring 3, which is an initial state. As the distance between two parallel sides of the limit slot 4 is greater than the diameter of the limit screw 6, the limit screw 6 is allowed to move and swing when the hydraulic valve set is subjected to a force. The movement includes forward and backward movement in the X direction, up and down movement in the Z direction, and minor movement in the Y direction. The swing includes circular swing around the Y direction, circular swing around the Z direction, and minor circular swing around the X direction.

The device is mounted into a hydraulic quick-coupling device and used to compensate position errors in an approaching process of two active coupling valve sets A and remove mechanical errors caused by wear and dislocation, so as to ensure smooth coupling.

The above technical solution of the present disclosure has the following beneficial superiority:

The present disclosure provides a solution for position errors and center mismatch in a coupling process, and provides technical support for a hydraulic automatic coupling technology. The present disclosure is simple in structure and concise in principle, includes internal components that are mostly sheet metal parts and welding parts, has low costs, and is strong and durable, and suitable for emergency rescue operations and construction machinery operations.

Figure 1:
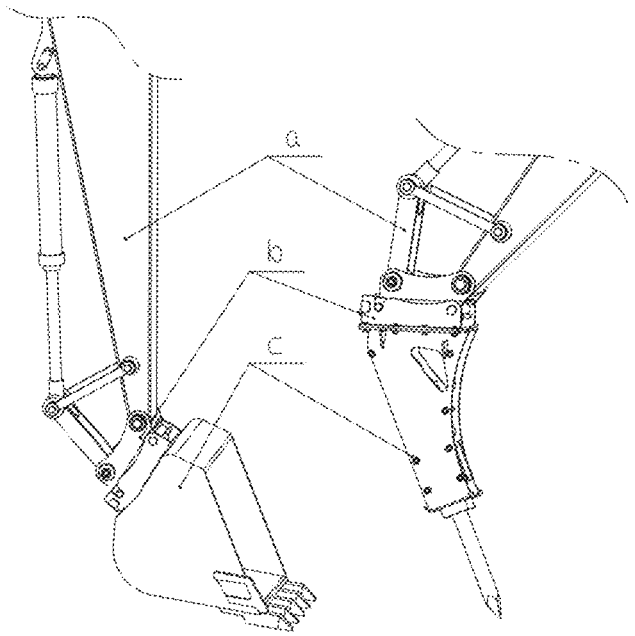
FIG. 1 is a schematic functional diagram of a hydraulic quick-coupling device provided by the present disclosure.
Figure 2:
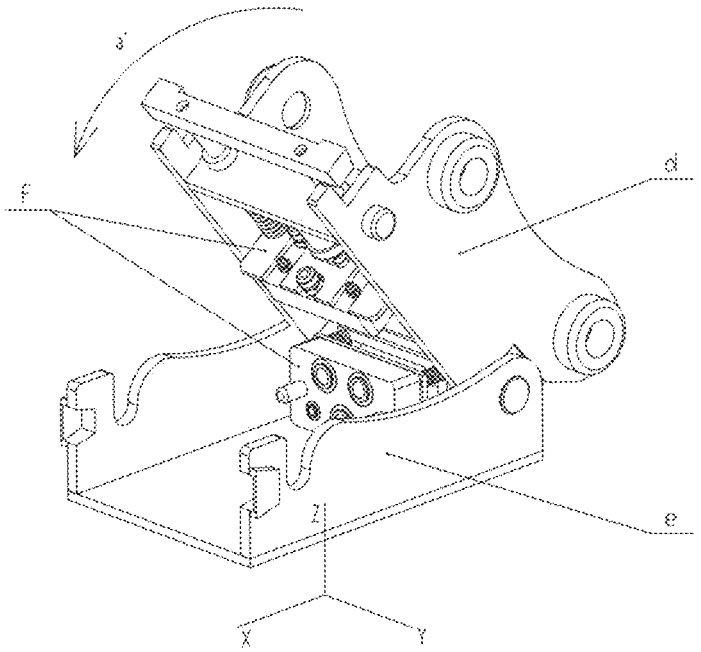
FIG. 2 is a structural principle diagram of the hydraulic quick-coupling device provided by the present disclosure.

In the present disclosure, as shown in FIG. 1, a working arm a is connected to the operation tools c through a quick-coupling device b. As shown in FIG. 2, the coupling platform includes an active coupling module d, a passive coupling module e, and a hydraulic coupling module f. The three modules can synchronously complete coupling of a hydraulic oil line while realizing connection of mechanical structures.

One part of the hydraulic coupling module f is located on the active coupling module d, is connected to an onboard hydraulic pump station, and provides a hydraulic power station The other part is located on the passive coupling module and connected to a hydraulic pipeline of the operation tools c. In operation, the two parts of the hydraulic element are required to accurately and quickly coupling completely. However, due to various assembly errors and position errors caused by wear and tear of machine parts, centers of the two hydraulic valve sets are misaligned; if tough coupling is performed at this point, the structure of the hydraulic valve set may be seriously damaged, and smooth completion of the coupling cannot be guaranteed.

The present disclosure provides a flexible coupling scheme for error compensation, so that one of the two coupling valve sets has multi-directional freedom and thus is optimized from rigid coupling to flexible coupling.

The hydraulic valve set is supported by the spring 3; when not subjected to an external force, the hydraulic valve set is on an outermost side of the X direction due to the support of the spring 3, which is an initial state. As the distance between two parallel sides of the limit slot 4 is greater than the diameter of a nut of the limit screw 6, the limit screw 6 can move freely within the limit slot 4, thus allowing degrees of freedom of movement and swing after the hydraulic valve set is subjected to a force. The degree of freedom of movement includes forward and backward movement in the X direction, up and down movement in the Z direction, and minor left and right movement in the Y direction. The degree of freedom of swing includes swing around the Y direction, swing around the Z direction, and minor swing around the X direction.

The present disclosure further provides rescue equipment, applied to disaster rescue sites. The rescue equipment includes an emergency rescue equipment working arm, a control system, and a hydraulic quick-coupling device, one end of the hydraulic quick-coupling device is connected to the control system through the emergency rescue equipment working arm, and the other end is connected to operation tools c.

The multi-degree-of-freedom automatic center-adjusting device and the hydraulic quick-coupling device provided in the embodiments of the present disclosure are introduced above in detail. The description of the above embodiments is intended only to assist in understanding the methods and core ideas of the present disclosure. At the same time, for those of general skill in the art, there will be changes in specific implementation modes and application scopes according to the ideas of the present disclosure. Based on the above, the contents of this specification shall not be construed as limiting the present disclosure.

If certain terms are used in the specification and claims to refer to specific components, those skilled in the art should understand that hardware manufacturers may use different terms to refer to the same component. This specification and claims do not use differences in name as a way of distinguishing components, but use differences in functionality of the components as a criterion for distinguishing the components. For example, the terms "include" and "comprise" in throughout the specification and claims are open-ended, and shall be interpreted as "including/comprising, but not limited to "Substantially" means that within an acceptable error range, those skilled in the art can solve the technical problems within a certain error range and basically achieve the technical effects. The subsequent description of the specification is a preferred implementation mode of implementing the present disclosure. However, the description is intended to explain the general principles of the present disclosure and is not intended to limit the scope of the present disclosure. The protection scope of the present disclosure shall be subject to that defined in the appended claims.

It should be further noted that the terms "include", "comprise" or any other variations intend to cover non-exclusive inclusion, so that a commodity or system including a series of elements not only includes the elements, but also includes other elements not explicitly listed, or further includes elements inherent to the commodity or system. In the absence of more limitations, the elements defined by the expression "including one . . . ," do not exclude that the commodity or system including the elements further has other identical elements.

It should be understood that the term "and/or" used herein is merely an association relationship describing associated objects, indicating that three relationships may exist, for example, A and/or B, indicating that there are three cases of A alone, A and B together, and B alone. In addition, the character "/" herein generally means that associated objects before and after it are in an "or" relationship.

Several preferred embodiments of the present disclosure are illustrated and described as above. However, as stated above, it should be understood that the present disclosure is not limited to the form disclosed herein, shall not be regarded as an exclusion of other embodiments, but shall be applicable to various other combinations, modifications and environments, and shall be able to be modified within the conception scope of the application by means of the above teachings or technologies or knowledge in the related art. Any modification or change made by those skilled in the art shall not depart from the spirit and scope of the present disclosure and shall be within the protection scope of the appended claims of the present disclosure.

What is claimed is:

1. A multi-degree-of-freedom automatic center-adjusting device, comprising an active coupling valve set, a spring, and a dynamic adjustment swing rack, wherein a first end of the dynamic adjustment swing rack is fixed to operation tools, and a second end of the dynamic adjustment swing rack is connected to the active coupling valve set through the spring, the dynamic adjustment swing rack comprises a frame, a limit slot, and a spring limit cylinder, wherein the frame supports and fixes the active coupling valve set, the limit slot defines a limit activity position of the active coupling valve set, and the spring limit cylinder constrains the spring, wherein the active coupling valve set comprises a hydraulic valve core, a guide sleeve, four limit screws, and a spring limit hole, wherein the spring limit hole is disposed at a back of the hydraulic valve core, the spring limit hole constrains the spring, the four limit screws are respectively mounted to an outer side of the hydraulic valve core, the four limit screws and the limit slot form a constraint relation to jointly constrain a displacement of the hydraulic valve core in an X direction and a Z direction, wherein four limit slots form four parallel sides, a distance between two parallel sides of each limit slot is greater than a diameter of each of the four limit screws, wherein the four limit screws move and swing when the hydraulic valve core is subjected to a force, wherein a movement of the four limit screws comprises a forward movement and a backward movement in an X-axis direction, an up movement and a down movement in a Z-axis direction, and a minor movement in a Y-axis direction, and the swing of the four limit screws comprises a circular swing with a Y-axis as an axis of symmetry, a circular swing with a Z-axis as the axis of symmetry, and a minor circular swing with an X-axis as the axis of symmetry.

2. The multi-degree-of-freedom automatic center-adjusting device according to claim 1, wherein the hydraulic valve core is supported by the spring, and when the hydraulic valve core is not subjected to an external force, the hydraulic valve core is on an outermost side of the X direction and the spring is in a non-deformed state.

3. A hydraulic quick-coupling device, comprising the automatic center-adjusting device according to claim 1, wherein the hydraulic quick-coupling device comprises an active coupling module, a passive coupling module, and a hydraulic coupling module, wherein the active coupling module is mounted to an end of an emergency rescue equipment working arm, the passive coupling module is fixed to the operation tools, the active coupling module is connected to the passive coupling module through the hydraulic coupling module, and the hydraulic coupling module comprises multiple sets of automatic center-adjusting devices and hydraulic joints.

4. The hydraulic quick-coupling device according to claim 3, wherein a plurality of hydraulic valve cores in the hydraulic coupling module comprise a unified oil channel interface, and the hydraulic coupling module connects and disconnects a hydraulic pipeline between the active coupling module and the passive coupling module.

5. The hydraulic quick-coupling device according to claim 3, wherein the dynamic adjustment swing rack is disposed in the passive coupling module.

6. The hydraulic quick-coupling device according to claim 3, wherein the active coupling module is mounted to the end of the emergency rescue equipment working arm.

7. The hydraulic quick-coupling device according to claim 3, wherein the active coupling valve set is disposed at the active coupling module, and the active coupling valve set is connected to the dynamic adjustment swing rack through the hydraulic joints.

8. A rescue equipment for disaster rescue sites, comprising the hydraulic quick-coupling device according to claim 3, wherein the rescue equipment further comprises the emergency rescue equipment working arm and a control system, a first end of the hydraulic quick-coupling device is connected to the control system through the emergency rescue equipment working arm, and a second end of the hydraulic quick-coupling device is connected to operation tools.

9. The hydraulic quick-coupling device according to claim 3, wherein the active coupling valve set comprises a hydraulic valve core, a guide sleeve, four limit screws, and a spring limit hole, wherein the spring limit hole is disposed at a back of the hydraulic valve core, the spring limit hole constrains the spring, the four limit screws are respectively mounted to an outer side of the hydraulic valve core, the four limit screws and the limit slot form a constraint relation to jointly constrain a displacement of the hydraulic valve core in an X direction and a Z direction.

10. The hydraulic quick-coupling device according to claim 9, wherein the hydraulic valve core is supported by the spring, and when the hydraulic valve core is not subjected to an external force, the hydraulic valve core is on an outermost side of the X direction and the spring is in a non-deformed state.

11. The hydraulic quick-coupling device according to claim 9, wherein four limit slots form four parallel sides, a distance between two parallel sides of each limit slot greater than a diameter of each of the four limit screws, wherein the four limit screws move and swing when the hydraulic valve core is subjected to a force, wherein a movement of the four limit screws comprises a forward movement and a backward movement in an X-axis direction, an up movement and a down movement in a Z-axis direction, and a minor movement in a Y-axis direction, and the swing of the four limit screws comprises a circular swing with a Y-axis as an axis of symmetry, a circular swing with a Z-axis as the axis of symmetry, and a minor circular swing with an X-axis as the axis of symmetry.

12. The rescue equipment according to claim 8, wherein a plurality of hydraulic valve cores in the hydraulic coupling module comprise a unified oil channel interface, and the hydraulic coupling module connects and disconnects a hydraulic pipeline between the active coupling module and the passive coupling module.

13. The rescue equipment according to claim 8, wherein the dynamic adjustment swing rack is disposed in the passive coupling module.

14. The rescue equipment according to claim 8, wherein the active coupling module is mounted to the end of the emergency rescue equipment working arm.

15. The rescue equipment according to claim 8, wherein the active coupling valve set is disposed at the active coupling module, and the active coupling valve set is connected to the dynamic adjustment swing rack through the hydraulic joints.

* * * * *